United States Patent [19]

Mayer

[11] Patent Number: 4,593,482

[45] Date of Patent: Jun. 10, 1986

[54] MODULAR SUBSTRATE SOLE FOR FOOTWEAR

[75] Inventor: Hubert Mayer, Marly, Switzerland

[73] Assignee: Bata Schuh AG, Mohlin, Switzerland

[21] Appl. No.: 635,939

[22] Filed: Jul. 30, 1984

[30] Foreign Application Priority Data

Sep. 29, 1983 [CH] Switzerland ..... 5290/83

[51] Int. Cl.[4] ..... A43B 3/10

[52] U.S. Cl. ..... 36/7.5; 36/28; 36/29; 36/32 R

[58] Field of Search ..... 36/7.5, 28, 29, 32 R, 36/3 B, 11.5, 32 A, 4

[56] References Cited

U.S. PATENT DOCUMENTS

| | | | |
|---|---|---|---|
| 1,377,908 | 5/1921 | Moore | 36/7.5 |
| 2,100,492 | 11/1937 | Sindler | 36/29 |
| 3,719,965 | 3/1973 | Chevallereau | 36/32 R |
| 4,236,326 | 12/1980 | Inohara | 36/3 B |
| 4,271,606 | 6/1981 | Rudy | 36/29 |
| 4,397,104 | 8/1983 | Doak | 36/29 |
| 4,507,879 | 4/1985 | Dassler | 36/28 |
| 4,536,974 | 8/1985 | Cohen | 36/3 B |
| 4,547,978 | 10/1985 | Radford | 36/29 |

FOREIGN PATENT DOCUMENTS

| | | | |
|---|---|---|---|
| 958766 | 9/1949 | France | 36/28 |
| 2006270 | 4/1969 | France | 36/29 |
| 149380 | 4/1932 | Switzerland | 36/11.5 |

*Primary Examiner*—Werner H. Schroeder
*Assistant Examiner*—Mary A. Ellis
*Attorney, Agent, or Firm*—Walter C. Farley

[57] ABSTRACT

A tread substrate or shoe sole for sandals, mules and other footwear includes a plurality of interconnected modular elements which can be joined together. The elements can be made from the same material or plural materials bonded together. The elements are substantially cylindrical and can have different diameters in a single sole structure. Additionally, the elements can be hollow cylindrical bodies and can have differing wall thicknesses and polygonal cross-sections.

8 Claims, 5 Drawing Figures

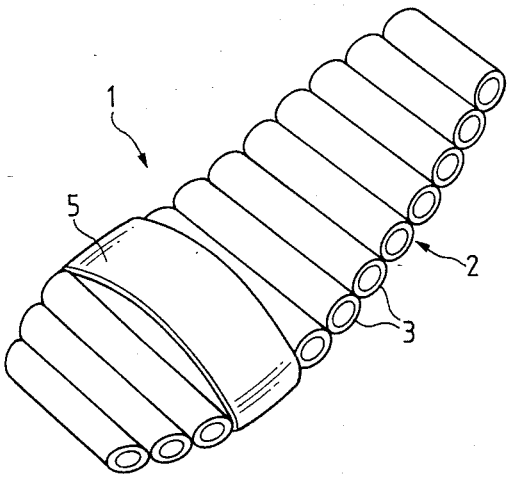
FIG. 1
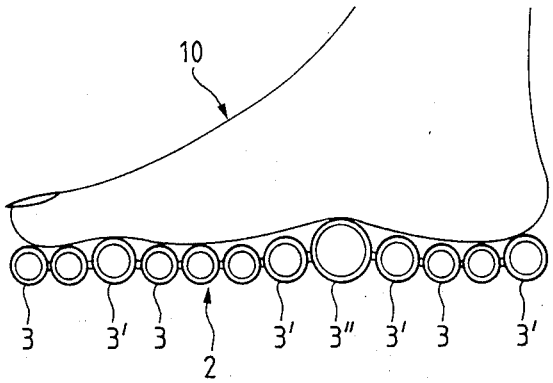
FIG. 2
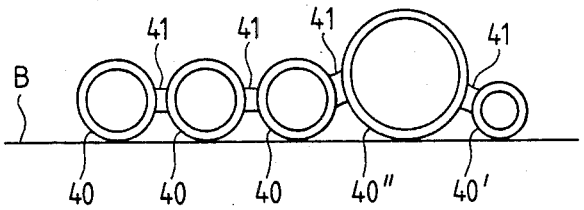
FIG. 3
FIG. 5
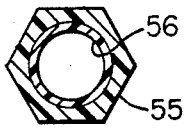
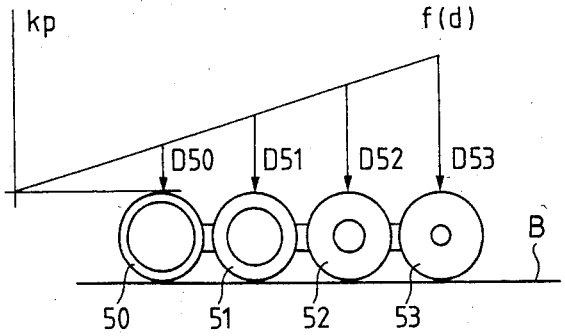
FIG. 4

MODULAR SUBSTRATE SOLE FOR FOOTWEAR

This invention relates to footwear and is directed particularly to a substrate especially useful as a sole or a portion of a sole for footwear such as sandals, strip sandals, mules, shoes and the like.

BACKGROUND OF THE INVENTION

The portions of open sandals or mule-like footwear on which the foot rests, which can be referred to as tread substrates, and also the footwear parts comprising the insoles in closed shoes are conventionally produced from flat materials of the desired thickness by cutting or punching a portion of the material in the shape of the foot. These flat materials can be pieces of leather, plastic or natural material mats or the like which can be laminated or in one piece and, after punching or cutting out, can be specially built up in subsequent production stages. This is frequently done in connection with raised heels, foot cavity shapes (i.e., shapes conforming to the plantar arch region), toe grippers and the like. Despite topographically skillful cutting and optimized packing of the foot shape surfaces, a certain material loss is unavoidable. Thus, in the cost calculations for the materials, the direct costs of the lost material can be decisive, i.e., the waste material can be more or less costly and may or may not be reusable.

When it is desired to produce a sole having a non-uniform thickness, there are production stages involving laminar structures which are assembled to approximate the anatomical variation of the bottom of the foot and, in such production stages, further material and processing costs are involved. It is also possible to produce contoured soles in a single production operation with minimum material losses by hot press or injection molding, but relatively expensive molds are then necessary.

In order to overcome these problems, it has been proposed to manufacture soles by extrusion, an example of which appears in U.S. Pat. No. 3,719,965 in which a wide strip having a variable thickness and having a width roughly corresponding to the foot length is extruded and, subsequently, the sole shape is cut out. Although this process results in a higher production rate of the extruded material, it is still necessary to go through a subsequent production step because the sole shape must be separately cut out.

From this it will be recognized that inconsistent requirements exist in that if a sole is to be produced while adhering to minimum production costs, the sole is cut from a flat material of the desired thickness following the shape of the human foot, giving a uniform sole of the same thickness from the toes to the heel. Alternatively, a sole which attempts to anatomically match the contours of the human foot is desirable, but the production costs rise with the measures taken for obtaining such shapes.

BRIEF SUMMARY OF THE INVENTION

Accordingly, an object of the present invention is to provide a tread substrate structure, particularly useful for sandals, mules, shoes and other forms of footwear which can be manufactured simply and inexpensively and which can nevertheless provide features of soles with anatomical configurations.

Briefly described, the invention comprises a base structure usable as a sole for footwear comprising a plurality of modular elements and means for interconnecting those elements.

Stated differently, the invention includes a load supporting structure usable as a foot support comprising a plurality of elongated bodies of elastomeric material extending transversely relative to the longitudinal axis of the foot, and means for interconnecting the bodies in a substantially parallel relationship.

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a perspective view of a mule having a modular tread substrate in accordance with the present invention;

FIG. 2 is a side elevation of the sole portion of the mule of FIG. 1;

FIG. 3 is an enlarged view of a portion of a sole structure in accordance with the invention;

FIG. 4 is an illustration of a plurality of bodies usable in a sole construction in accordance with the invention, the bodies having varying load-bearing characteristics; and FIG. 5 is a sectional view of a component for a sole in accordance with the invention.

DETAILED DESCRIPTION OF PREFERRED EMBODIMENTS

FIG. 1 illustrates a mule indicated generally at 1 having a sole indicated at 2 and a strap 5 which extends across the top of the foot. This represents the basic construction of a modular tread substrate in accordance with the invention in the context of a very simple article of footwear. In this embodiment, sole 2 includes a plurality of interconnected, substantially tubular elements 3. It will be recognized that for this kind of modular construction, it is possible to use cylindrical elements as well as elliptical elements and that the cylindrical elements can be circular, polygonal, or other shapes. Thus, in order to arrive at a shoe model having specific shape or material characteristics, it is possible to individually produce a special profile which represents a tread substrate or sole and which satisfies the sought after comfort and wearing demand.

It is also possible to use modular elements having spindle-like bulges for a sole, i.e., axial variations in diameter, which permit adequate support in the plantar arch region of the foot. Such additional elements do not increase the manufacturing cost but, rather, offer characteristics of comparable sole shapes according to the prior art but at much lower cost. It is also possible to combine materials having different characteristics, as will be described, without this significantly increasing the complication or cost of manufacture. The modular construction according to the invention also makes it possible to produce very complex and therefore expensive shoes so that the invention is not limited to the production of cheap soles or tread substrates, although this constitutes the basic object of the invention.

The sole thickness can also vary widely. For example, it is possible to use spaghetti-like modular shapes to thereby produce comfortable in soles. When using modules having longitudinal capillary cavities, such cavities can be employed for receiving perfumes which intermittently release vapors into the atmosphere in the manner of small nozzles when the wearer treads on the sole. Thicker soles can be used for producing footwear ranging from bathroom mules to multipurpose sandals. It is possible to introduce the foot loops by which the sole can be attached to the foot into the existing passages.

FIG. 2 shows a side elevation of a sole 2 having an engaged foot 10 and in which tubular elements 3, 3' and 3" are combined into a sole, these elements having different diameters from each other. At the end of the sole beneath the toes, there are two elements 3 the diameters of which are approximately equal to the average thickness of the sole. In the region of the base of the toe, there is an element 3' with a somewhat larger diameter. Thus, the surface of the elements on which the foot rests has a raised portion which can be gripped with the toes. This simple measure alone greatly improves the engagement of the foot with the sole. Following element 3' are three subsequent elements 3, followed by an element 3' having an increased diameter which can extend over the entire width of the sole, followed by a still larger diameter element 3" which serves as a foot cavity or arch support and can comprise a special element having spindle-shaped bulges which are integrated into the element. This largest diameter element 3" is followed by a further transition element 3', two elements 3 and a final element 3' which is used at the rear of the heel to improve the gripping characteristics. This sequence of elements is, of course, only one example of numerous embodiments which can be arrived at to suit various circumstances.

FIG. 3 is an enlarged illustration which illustrates manufacturing details more clearly. The structure of FIG. 3 includes cylindrical elements 40, 40' and 40" having different diameters. On a surface B which represents the floor or other base for the substrate or sole, there are five interconnected transverse modules or elements which are shown in side elevation. In order to have good support, the portions of the elements which face away from the foot-contacting surfaces of the elements are arranged to lie in a single plane, regardless of the diameters of the elements. The adjacent elements are interconnected by techniques such as injection molding. The means for interconnecting the modules are illustrated at 41 as joints which can be thermally formed when injection molding is used. With this modular arrangement, there are numerous "degrees of freedom" in order to produce the corresponding sole shapes, the invention being eminently suitable for assembly line production.

When producing soles of the same thickness, it is also possible to arrange the cylindrical elements or modules extending in the longitudinal direction of the foot. However, this is only recommended when constructing relatively thin soles unless a specially usable effect is achievable with such an arrangement. The transverse structuring of the sole normally counteracts the normal rolling of the foot.

FIG. 4 illustrates how the use of modules with different wall thicknesses d can control the load distribution characteristics of the structure. As shown therein, elements 50, 51, 52 and 53 have increasing wall thicknesses so that each can withstand a specific deformation compressive force, the forces increasing from element 50 to element 53. As illustrated, if the elements are located on a fixed surface B and subjected to test forces resulting in a specific amount of deformation, the resulting pressure vectors D50–D53 are the results for equal deformations. The diagram thus illustrates a pressure function as a function of the arrangement of elements having different wall thicknesses. These elements are joined by welds.

If the arrangement of the elements is varied, then the function f(d) of the deformation pressure varies. It will be recognized, of course, that the function is not a continuous one, the loading vectors having been combined into a function for purposes of illustration by interpolation alone. As a function of requirements and the low distribution over the sole, corresponding functions can easily be combined, for example, in the heel region or in the area where the balls of the foot rest. Such measures increase the wearing comfort and can be introduced without difficulty in the modular construction. Once again, cost and effort is only insignificantly increased. However, exposed areas can be provided with reinforced materials when the objective is to provide a sole having overall wear resistance or overall lengthened service life. The combination of several of the described measures leads to remarkable products at low cost.

The modular assembly as taught herein can be used for obtaining further characteristics. These include massaging effects which can be very advantageous for the feet in which the cavities can be used in many different ways, one of which has been mentioned. It is also possible to produce small, carpet-like tread substrates for foot gymnastics. For all uses, it is possible to influence the choice of materials and consequently the manufacturing costs while optimizing the costs.

As illustrated in FIG. 5, combinations of materials can be used to form composite elements having characteristics which would be difficult to achieve with a single material. It is possible, for example, to use an outer cylindrical body of material 55 with an inner sleeve of material 56, the two materials having different moduli of elasticity. For example, a relatively stiff, inelastic material can be used as the inner sleeve with the outer material being softer and therefore more comfortable. The outer portion 55 can be polygonal, as shown, or circular.

From the foregoing, it will be recognized that the invention provides a tread substrate, particularly a sole for sandals, mules, and the like in which the sole 2 of tread substrate 1 comprises a plurality of interconnected modular elements 3. The elements are preferably made from the same material and are interconnected by joint elements 41. However, multiple materials can be used.

The shapes of the modular elements 3, 3', 3" is preferably substantially cylindrical and different diameters can be used in the structure. Alternatively, the modular elements can be cylindrical with a polygonal cross-section.

Elements 3, 3', 3", 50, 51, 52 and 53 can also be hollow cylindrical tubes with varying wall thicknesses d. Furthermore, the assembly of the elements can be arranged in accordance with the deformation pressure characteristics in accordance with a function of the low distribution which is related to the sole.

While certain advantageous embodiments have been chosen to illustrate the invention, it will be understood by those skilled in the art that various changes and modifications can be made therein without departing from the scope of the invention as defined in the appended claims.

I claim:

1. A footwear sole structure comprising a plurality of elongated modular elements of the same material; and a plurality of intermediate joint members of the same material as said elements fixedly attached between and interconnecting said modular elements in generally parallel, side-by-side relationship in a single layer, the layer thus formed being adapted to constitute the entire sole structure between a foot and a supporting surface.

2. An article of footwear comprising a plurality of generally cylindrical modular elements of the same material;

a plurality of joint members of the same material as said modular elements extending between and fixedly interconnecting said modular elements in substantially parallel, side-by-side relationship to form a sole; and means connected to said sole for holding said sole on a foot with the axes of said elements extending generally perpendicular to the longitudinal axis of the foot and such that said modular elements form the only significant portion of said article of footwear between the foot and a supporting surface.

3. A structure according to claim 1 wherein each of said modular elements comprises a substantially cylindrical body and said plurality of elements includes cylindrical bodies of different diameters.

4. A structure according to claim 3 wherein each of said elements comprises a substantially cylindrical body having a polygonal cross-section.

5. A structure according to claim 3 wherein a portion of each of said elements is made from a first material and the remainder thereof is made from a second material attached to said first material.

6. A structure according to claim 1 wherein each of said bodies is hollow and said plurality of elements includes bodies having different wall thicknesses to provide different load-bearing capacities.

7. A structure according to claim 6 wherein said bodies are joined together in an order such that their load-bearing capacities are in accordance with a predetermined load distribution function.

8. An article according to claim 2 wherein said plurality of modular elements includes elements of different diameters, and wherein said joint members are attached to said elements such that one side of each of said elements lies in a single plane and can therefore rest on a flat support surface.

* * * * *